US006018277A

United States Patent [19]

Väisänen

[11] Patent Number: 6,018,277

[45] Date of Patent: Jan. 25, 2000

[54] SERIES OF STRIP LINES FOR PHASING AND BALANCING A SIGNAL

[75] Inventor: Risto Väisänen, Salo, Finland

[73] Assignee: Nokia Mobile Phones Limited, Espoo, Finland

[21] Appl. No.: 09/044,267

[22] Filed: Mar. 19, 1998

[30] Foreign Application Priority Data

Mar. 20, 1997 [FI] Finland ..... 971165

[51] Int. Cl.[7] ..... H01P 5/10

[52] U.S. Cl. ..... 333/26; 333/161; 333/204

[58] Field of Search ..... 333/25, 26, 204, 333/205, 246, 161

[56] References Cited

U.S. PATENT DOCUMENTS

| | | | |
|---|---|---|---|
| 4,361,818 | 11/1982 | Otremba | 333/26 |
| 4,739,289 | 4/1988 | Cripps | 333/26 |
| 5,001,372 | 3/1991 | Nyqvist | 307/529 |
| 5,061,910 | 10/1991 | Bouny | 333/26 |
| 5,361,050 | 11/1994 | Einbinder | 333/204 |
| 5,379,458 | 1/1995 | Vaisanen | 455/330 |
| 5,430,895 | 7/1995 | Huusko | 455/327 |
| 5,534,830 | 7/1996 | Ralph | 333/128 |
| 5,697,088 | 12/1997 | Gu | 333/204 X |
| 5,777,527 | 7/1998 | Sanders | 333/26 |

FOREIGN PATENT DOCUMENTS

| | | | |
|---|---|---|---|
| 0213864 A3 | 3/1987 | European Pat. Off. . | |
| 0419756 | 4/1991 | European Pat. Off. . | |
| 0464608 A1 | 1/1992 | European Pat. Off. . | |
| 87408 | 9/1992 | Finland . | |
| 91930 | 5/1994 | Finland . | |
| 59-148405 | 8/1984 | Japan | 333/26 |

*Primary Examiner*—Seungsook Ham
*Attorney, Agent, or Firm*—Perman & Green, LLP

[57] ABSTRACT

The invention relates to processing of radio frequency signals, particularly to the balancing of signals. The phasing and balancing member according to the invention is based on the use of four parallel strip lines (10, 20, 30, 40). The strip lines are combined as two pairs (10, 40; 20, 30), which are located within each other. In the line pair (20, 30) connected the unbalanced signal the other ends (22, 32) are interconnected, and in the line pair (10, 40) connected to the balanced signal the other ends (12, 42) are connected to a point corresponding to the signal's zero potential. In the different lines of each pair the signal travels in opposite directions, whereby the radiation fields generated by the signals travelling in the different lines substantially cancel each other. Preferably capacitive members (50, 60) are further connected to those ends (14, 44; 24, 34) of the strip line pairs which are connected to the signals, whereby each strip line pair in combination with the capacitive member connected to it forms a resonance circuit.

6 Claims, 6 Drawing Sheets

SERIES OF STRIP LINES FOR PHASING AND BALANCING A SIGNAL

BACKGROUND OF THE INVENTION

The invention relates to processing of radio frequency signals, particularly to the balancing of signals.

Transformers are usually used for the balancing and phasing of radio frequency signals. Transformers wound on a ferrite core perform well at low frequencies. When the frequency increases the characteristics of the ferrite core deteriorate, so that ceramic bodies are typically used as transformer cores in the 900 MHz frequency range, for instance.

Wound transformers are expensive, however, and therefore also strip line transformers according to FIG. 1*a* are used at high frequencies. Regarding the balancing characteristics at high frequencies a strip line transformer performs at least as well as wound transformers, and a strip line transformer is also very cheap to manufacture. The strip line transformer according to FIG. 1*a* is described in more detail in the Finnish patent publication No. 91930, or in the corresponding British patent application publication GB-9203902.3.

FIGS. 1*b* and 1*c* show examples of some other prior art structures realised with strip lines. The structures of FIG. 1*b* and 1*c* are band-pass filters. It is typical for these structures that the length of the strips is determined according to the operating frequency of the structure, whereby the length of the structure can not be freely selected. Other structures realised with strip lines, such as filters and directional couplers of other types, are described in the books Leo Young, "Microwave Filters Using Parallel Coupled Lines", Artech House, Dedham, Mass. 1972, and Matthaei, Young, Jones, "Microwave Filters, Impedance-Matching Networks and Coupling Structures", Artech House, Dedham, Mass. 1980.

However, there are certain problems with the strip line transformers. The relatively large area on a printed circuit board required by a strip line transformer has many inconvenient effects. The signal strength radiated by a member formed by strip lines on a printed circuit board is directly proportional to the member's size, so the signals appearing in a strip line transformer are easily coupled by radiation to other stages of the device, and correspondingly, signals from other stages are easily coupled to the strip line transformer. Mounting errors in other parts of the devices will also easily influence the characteristics of a strip line transformer due to the large area of a strip line transformer. A typical mounting error causing problems in connection with strip line transformers is RF shielding cover askew: because the area of the strip line transformer is rather large the distance to the skew RF shielding cover will vary, when measured at different positions of the strip line transformer. This has an influence i.a. on the balance characteristics of the strip line transformer.

An object of the invention is to realise a phasing and balancing member, which has a smaller size than prior art solutions. An object of the invention is also to realise a phasing and balancing member, which causes less high frequency radiation than a strip line transformer. A further object of the invention is to realise a phasing and balancing member, which is less sensitive to external interference signals than a strip line transformer.

SUMMARY OF THE INVENTION

The objects are attained by realising the phasing and balancing member with two strip line pairs located within each other, whereby the ends opposite to those ends connected the unbalanced signal in one line pair are interconnected, and whereby the ends opposite to those ends connected to the balanced signal in the second line pair are connected to a point corresponding to the zero potential of the signal. Then the signal in each pair travels in opposite directions in the lines of a pair, whereby the radiation fields generated by the signal in the different lines substantially cancel each other.

A phasing and balancing member according to the invention is characterised in that which is stated in the characterising part of the independent claim directed to a phasing and balancing member. A mobile communication means according to the invention is characterised in that which is stated in the characterising part of the independent claim directed to a mobile communication means. The dependent claims describe further advantageous embodiments of the invention.

The phasing and balancing member according to the invention is based on the use of four parallel strip lines. The strip lines are combined as two pairs, which are located within each other. In the line pair connected to the unbalanced signal the other ends are interconnected, and in the line pair connected to the balanced signal the other ends are connected to a point corresponding to the signal's zero potential. In the different lines of each pair the signal travels in opposite directions, whereby the radiation fields generated by the signals travelling in the different lines substantially cancel each other. Preferably there are further capacitive members connected to the ends of the strip line pairs, which are connected to the signals, whereby each strip line pair in combination with the capacitive member connected to it forms a resonance circuit.

DESCRIPTION OF THE DRAWINGS

The invention is described in more detail below with reference to the drawing in which.

The same reference numerals and markings are used for equivalent parts.

It is already known to use parallel strip lines in a filter, in which the strip lines are shortened by a capacitance. In the solution according to the invention the parallel strip lines are used for signal balancing or for signal phasing.

Figure 2:
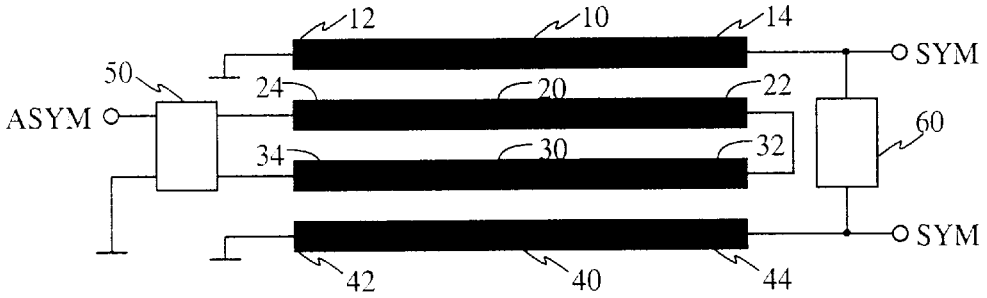
FIG. 2 shows a preferred embodiment of the invention.

FIG. 2 shows an advantageous embodiment of the invention. In this embodiment the first ends 22, 32 of the middle strip lines 20, 30 are shorted. A first capacitive matching member 50 is connected between the other ends 24, 34, whereby the middle strip lines 20, 30 and the first capacitive matching member 50 form a first resonance circuit having a certain resonance frequency predetermined by the dimensioning of the strip lines 20, 30 and the first capacitive matching member 50.

The unbalanced signal is supplied to the input ASYM of the capacitive member. The first ends 12, 42 of the outer strip lines 10, 40 are connected to a point corresponding the zero potential of the balanced signal. In the embodiment of the FIG. 2 the ends of said strip lines are connected to the ground. A second capacitive member 60 is coupled between the other ends of the outer strip lines, whereby the resonance circuit formed by the outer strip lines 10, 40 and the second capacitive member 60 can be made to resonate at the desired operating frequency with the aid of this capacitive member. The desired balanced signal is obtained at the terminals of the second capacitive member 60. The phase difference of the signal is 180 degrees between said terminals.

The signal can also travel in a direction opposite to that described above, whereby the balanced signal is supplied to the terminals SYM and the unbalanced signal is obtained at the terminal ASYM.

In an advantageous embodiment of the invention the resonance frequency generated by the first strip line pair 20, 30 and the first capacitive matching member 50 is substantially the same as the resonance frequency of the resonance circuit formed by the second strip line pair 10, 40 and the second capacitive matching member.

Figure 3:
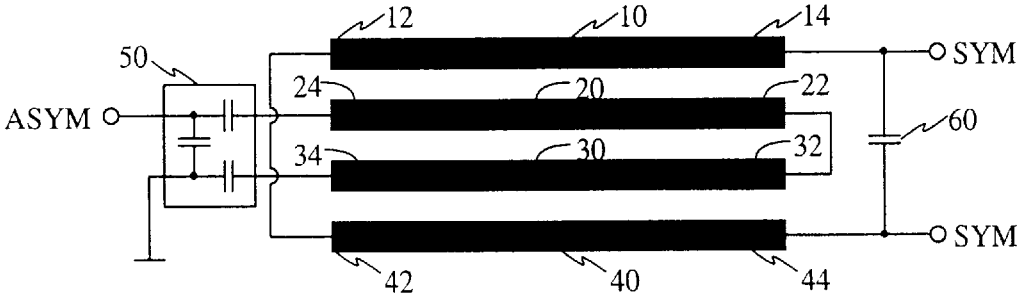
FIG. 3 shows another preferred embodiment of the invention.

FIG. 3 shows an advantageous structure for the first capacitive member 50. Advantageously the first capacitive matching member 50 can comprise three capacitors, as shown in FIG. 3. Advantageously the second capacitive member 60 can comprise one capacitor, as shown in FIG. 3.

The first ends 12, 42 of the strip lines carrying the balanced signal are connected to a point which corresponds to the zero potential of the balanced signal, as was mentioned in connection with the description of FIG. 2. In the example of FIG. 2 said first ends 12, 42 are connected to ground. They can also be interconnected, as in the embodiment shown in FIG. 3, or an RF signal at the ends can be connected to ground through capacitors.

Figure 4:
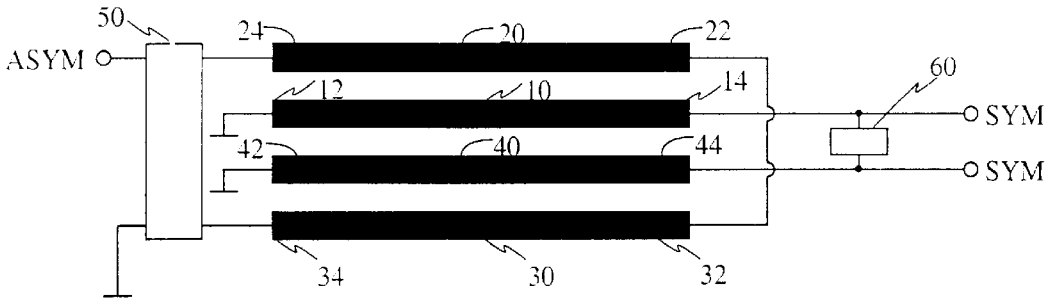
FIG. 4 shows a third preferred embodiment of the invention.
Figure 5:
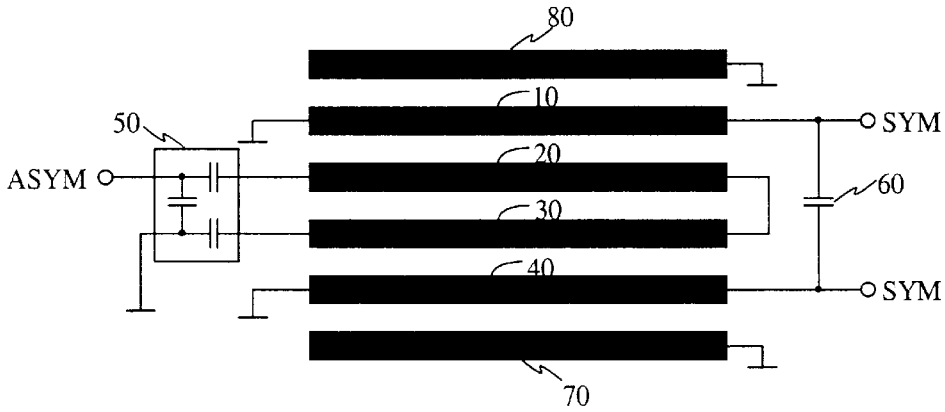
FIG. 5 shows a fourth preferred embodiment of the invention.

FIG. 4 shows an advantageous embodiment of the invention in which the strip lines 10, 40 carrying the balanced signal are the inner lines, and the strip lines 20, 30 carrying the unbalanced signal are the outer lines. In other respects the function of the embodiment in FIG. 4 corresponds to that of FIG. 2.

A problem with balancing and phasing members realised on printed circuit boards having very densely located components is the influence of other adjacent components or strip lines on the balancing characteristics. The influence of the adjacent components can be substantially reduced by strip lines 70, 80, which are formed adjacent to the phasing and balancing member, and which are connected to the ground at least at one point. Close to the grounded strip lines it is possible to locate other components, which then have substantially no negative influence on the phasing and balancing member.

Figure 6:
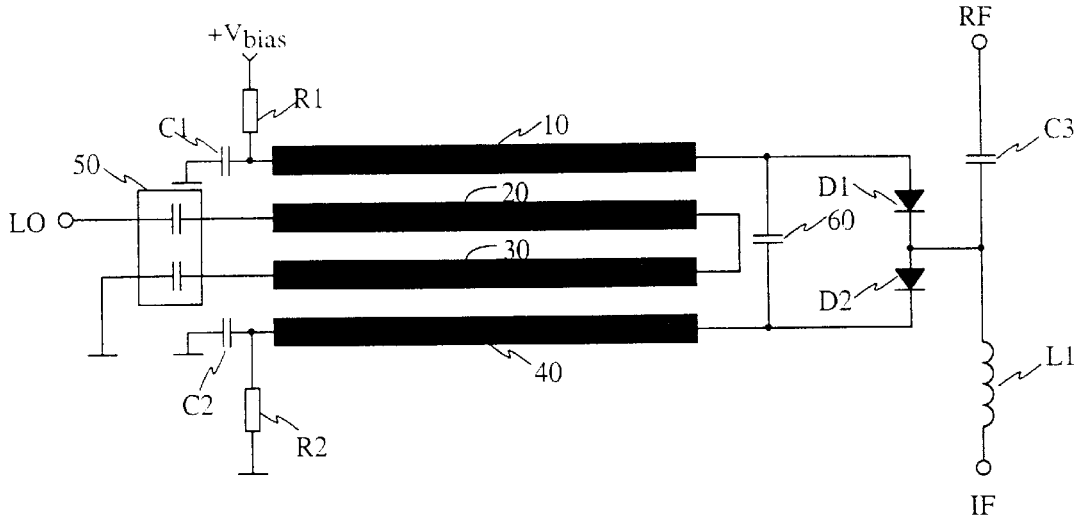
FIG. 6 shows a mixer realised with a structure according to the invention.

FIG. 6 shows a biased diode mixer as a possible application of the phasing and balancing member. A mixer of this type has two inputs, the local oscillator signal input LO and the high frequency signal input RF. The mixing of these signals results in the intermediate frequency which is connected to the output IF. A DC current is supplied via resistors R1, R2 to the ends of the outer strip lines 10, 40, whereby the current is connected to the diodes D1, D2 through the strip lines. Regarding the high frequency signal the ends of the strip lines are connected to ground by the capacitors C1, C2. In this embodiment the first capacitive member 50 comprises two capacitors, whereby the local oscillator signal at the input LO is galvanically isolated from ground. The purpose of the capacitor C3 is to transmit the high frequency signal at the RF input to the mixer. The purpose of the inductance L1 in this circuit is to prevent the high frequency signal from passing to the intermediate frequency signal output IF.

The solution shown in FIG. 6 also illustrates an inventive application, in which both strip line pairs do not form a resonance circuit. In the embodiment of this figure the strip lines 20, 30 conveying the unbalanced signal in combination with the first capacitive member 50 do not form a resonance circuit resonating at the operating frequency. In this embodiment the strip lines 10, 40 conveying the balanced signal and the second capacitive member 60 form a resonance circuit, whose resonance frequency substantially corresponds to the local oscillator frequency.

Figure 7:
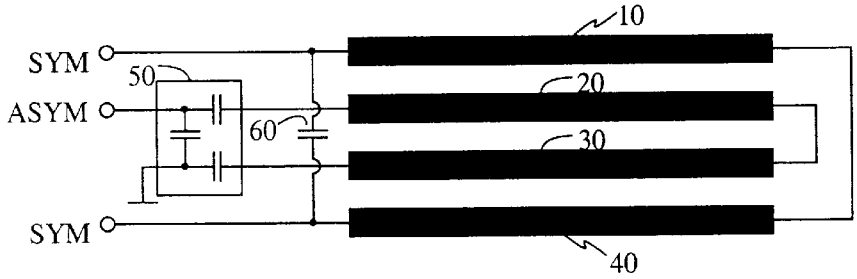
FIG. 7 shows a preferred embodiment of the invention, in which the unbalanced and the balanced signals are supplied to the structure according to the invention at the same end of the structure.

Above we presented illustrative examples of such inventive embodiments, in which either the balanced signal or the unbalanced signal is supplied to the first end of the strip line structure and the other signal is output at the other end of the strip line structure 10, 20, 30, 40. FIG. 7 shows a structure, in which one of the signals is supplied to one end of the strip line structure 10, 20, 30, 40, and the other signal is output at the same end. In other respects the function of this embodiment corresponds to that of e.g. FIG. 2. The balancing characteristics of the solution according to FIG. 7 are not necessarily as good as the characteristics of the embodiment shown in FIG. 2, because the direct coupling between the adjacent terminals SYM, ASYM may disturb the balance of the structure. An embodiment of this type may be suitable for instance in such applications where both terminals SYM, ASYM of the phasing and balancing member are connected to the same integrated circuit.

Figure 8A:
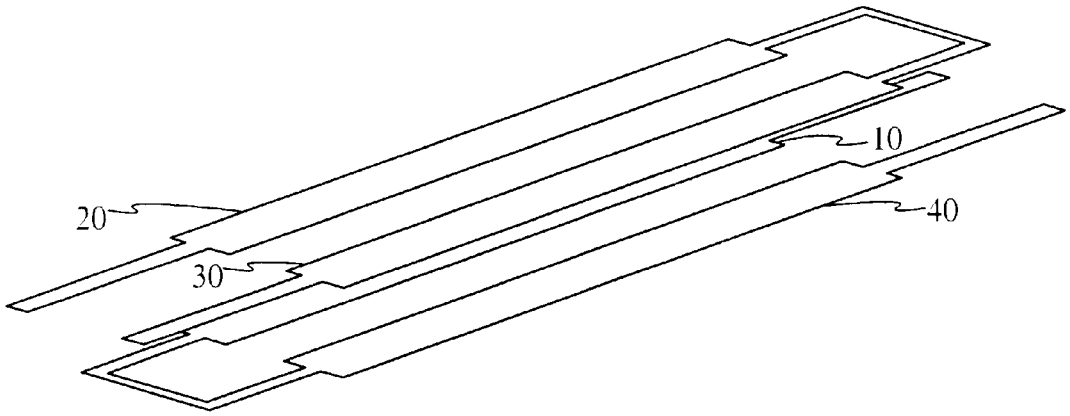
FIG. 8*a* shows a preferred embodiment of the invention, which utilises the different layers of a multilayer printed circuit board.
Figure 8B:
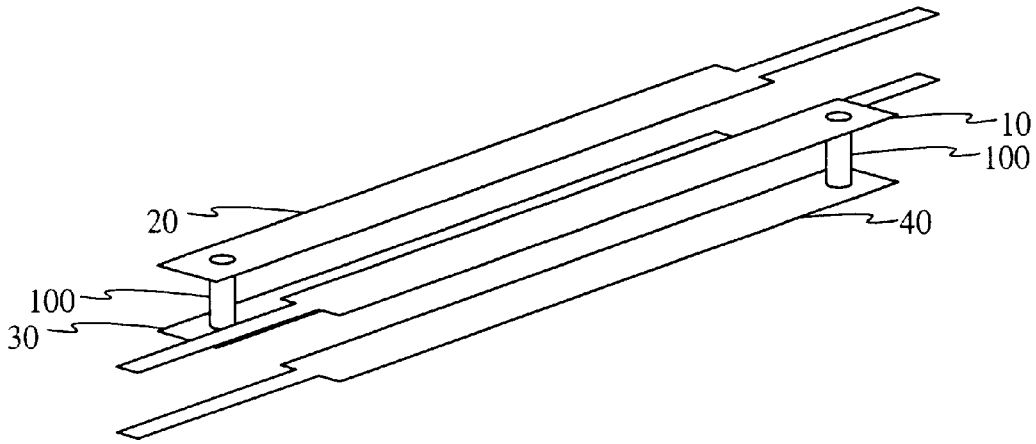
FIG. 8*b* shows another preferred embodiment of the invention, which utilises the different layers of a multilayer printed circuit board.

In the above examples we presented illustrative structures realised in one plane. The structure according to the invention can also be realised utilising the different layers in a multilayer printed circuit board, whereby the strip line pairs can be located in different layers of the printed circuit board. In such a structure the strip line pairs can for instance be parallel, but located in different layers of the printed circuit board. The strip line pairs 10, 40; 20, 30 can for instance be fully superimposed, in the manner shown in FIG. 8*a*. On the multilayer printed circuit board the phasing and balancing member according to the invention can also be realised so that the strips 10, 40; 20, 30 of a pair are on different levels, in the manner shown in FIG. 8*b*, whereby their connections at one end can be realised for instance by a leadthrough member 100 in accordance with the printed circuit board technology which is used. For the sake of clarity, the other components of the phasing and balancing member according to the invention and the printed circuit board are not shown in the FIGS. 8*a* and 8*b*, and the strips in the first layer of the printed circuit board are drawn as solid lines, and the strips and any lead-throughs in the second layer of the printed circuit board are drawn as broken lines.

Figure 9:
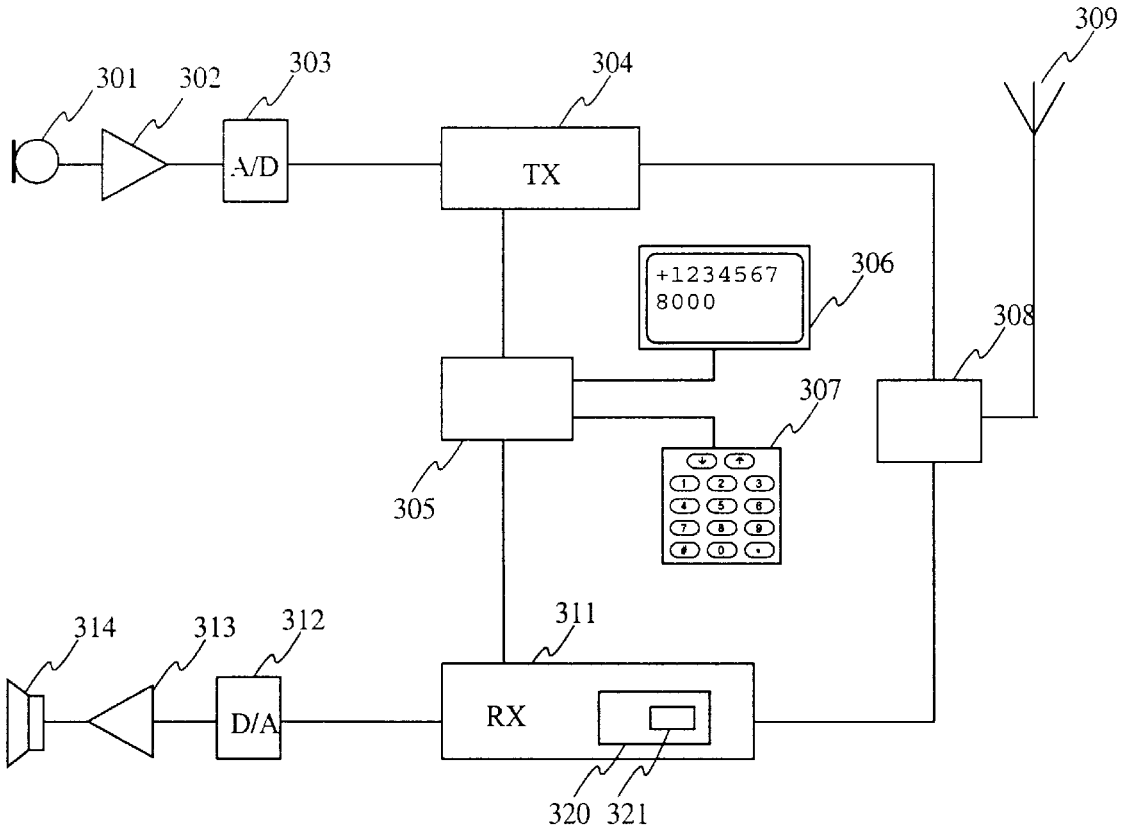
FIG. 9 shows a preferred embodiment of the invention, in which a phasing and balancing member according to the invention is utilized in a mobile communication means.

FIG. 9 shows a block diagram of a digital mobile communication means according to an advantageous embodiment of the invention. The mobile communication means comprises a microphone 301, keyboard 307, display 306, earpiece 314, antenna duplexer or switch 308, antenna 309 and a control unit 305, which all are typical components of conventional mobile communication means. Further, the mobile communication means contains typical transmission and receiver blocks 304, 311. Transmission block 304 comprises functionality necessary for speech and channel coding, encryption, and modulation, and the necessary RF circuitry for amplification of the signal for transmission. Receiver block 311 comprises the necessary amplifier circuits and functionality necessary for demodulating and decryption of the signal, and removing channel and speech coding. The signal produced by the microphone 301 is amplified in the amplifier stage 302 and converted to digital form in the A/D converter 303, whereafter the the signal is taken to the transmitter block 304. The transmitter block encodes the digital signal and produces the modulated and amplified RF-signal, whereafter the RF signal is taken to the antenna 309 via the duplexer or switch 308. The receiver block 311 demodulates the received signal and removes the encryption and channel coding. The resulting speech signal is converted to analog form in the D/A converter 312, the output signal of which is amplified in the amplifier stage 313, whereafter the amplified signal is taken to the earpiece 314. The control unit 305 controls the functions of the mobile communication means, reads the commands given by the user via the keypad 307 and displays messages to the user via the display 307. According to an advantageous embodiment of the invention, the mobile communication means further comprises a mixer 320 in the receiver block 311. The mixer can, for example, be of the type presented in FIG. 6 and described previously. The mixer 320 in turn comprises a phasing and balancing member 321, which can, for example, be of the type a presented in FIG. 6 and described previously. However, the invention is not limited to the use of the phasing and balancing member of FIG. 6 in a mobile communication means. Also other types of phasing and balancing members according to the invention, such as any of those described in this specification, can be used in a mobile communication means. The present invention is not limited to the embodiment of FIG. 9, which is presented as an example only. For example, the invention can as well be applied to an analog communication means. Such mobile communication means can, for example, be constructed for communication in the GSM (Global System for Mobile communications) network, UMTS (Universal Mobile Telecommunication System) network or any other mobile communication network, including, but not limited to, so called third generation mobile communication networks using, for example, the W-CDMA technology.

The structure according to the invention can be realised as a very narrow structure, whereby the phasing and balancing member according to the invention can be used as a conventional transmission line to convey a signal on the printed circuit board. The signal can be balanced and at the same time convey from one point to another, for instance with the structure of FIG. 2. If the width of the strip lines is 0.2 mm, and when they are placed at a mutual distance of 0.2 mm, then a structure formed by four strip lines has a width of 1.4 mm. On the other hand, when the printed circuit board has a thickness of 1 mm, then in the 900 MHz frequency range a strip line with the impedance 50 ohm is about 1.6 mm wide. Thus the phasing and balancing member according to this example fits in the same space as a common 50 ohm transmission line. The length of the structure formed by the strip lines can be changed by changing the dimensioning of the capacitive members 50, 60 at the ends of the strip lines in a manner well known to a person skilled in the art. The dimensioning of the structure according to the invention is not dependent on the wavelength of the conveyed signal, its parts or multiples, but its length can be freely defined, because it is not necessary for the strips to have a certain length which is proportional to the signal's wavelength. With the aid of the invention a signal can be transformed during the conveyance from an unbalanced signal to a balanced signal, and vice versa.

The structure according to the invention can be advantageously used in many different circuit means, such as in balanced mixers, I/Q modulators and I/Q demodulators.

To a person skilled in the art it is obvious that the strip lines can be of the microstrip type or the stripline type, for instance. It is also obvious that the capacitive members 50, 60 can be realised by discrete components, microstrip techniques, or by any other prior art means.

In series production the solution according to the invention is substantially cheaper than a phasing and balancing member realised with a wound transformer.

The electromagnetic radiation generated by the solution according to the invention and possibly coupled to other circuits of the equipment is lower than the radiation caused by prior art strip line solutions, because the electromagnetic radiation generated by a resonance circuit realised with strip lines is proportional to the area of the resonance circuit. The area of a phasing and balancing member according to the invention is substantially smaller that the area required by a prior art strip line transformer. The smaller area compared to prior art, which the solution according to the invention requires on a printed circuit board, also directly decreases the manufacturing costs, due to the saved printed circuit board area.

The radiation is further decreased by the fact that the currents flow in opposite directions in the different strip lines of the strip line pairs 20, 30 and 10, 40, whereby the electromagnetic fields generated by the currents flowing in the strip lines substantially cancel each other. Less interference is thus coupled through radiation to the other circuits of the equipment, and the required shielding structures can be substantially simpler and cheaper. Interference coupled to the phasing and balancing member is also lower, because the interference coupled to the different strip lines of the strip line pairs 20, 30 and 10, 40 substantially cancel each other.

The characteristics of the structure according to the invention is further improved by the fact that the short distance between parallel strip lines will reduce the detrimental effects, which any local variations in the printed circuit board material can have on the characteristics of the structure.

Figure 1A:
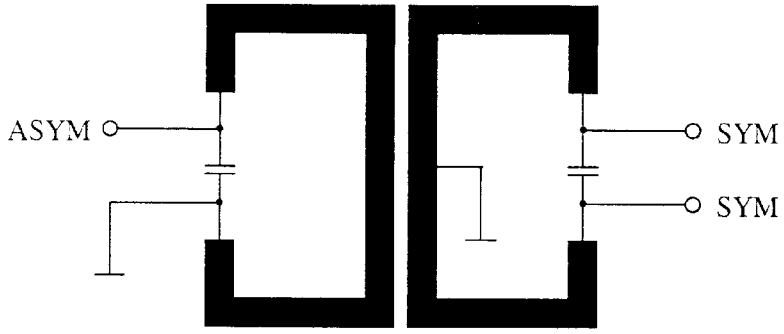
Fig. 1a PRIOR ART
FIG. 1*a* shows a prior art strip line transformer.
Figure 1B:
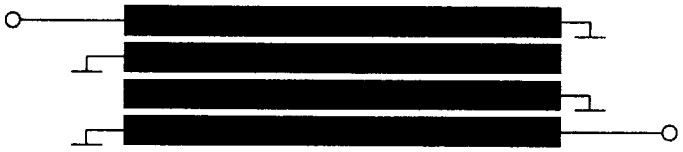
Fig. 1b PRIOR ART
FIG. 1*b* shows a prior art strip line filter.
Figure 1C:
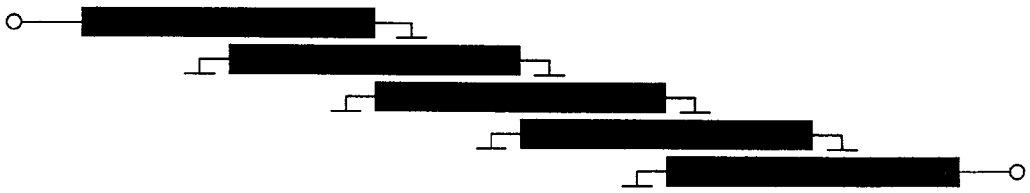
Fig. 1c PRIOR ART
FIG. 1*c* shows another prior art strip line filter.

The solution according to the invention is also less sensitive to installation errors of any RF shields. Because the structure according to the invention is narrow, all strip lines will have almost identical distances to an RF shield, which is possible mounted erroneously askew over the structure. For instance, a mounting error of this kind will have a substantial effect on the characteristics of the prior art strip line transformer shown in FIG. 1, because the distances between the strip lines in this strip line transformer and the RF shield will be different at different points of the structure, due the relatively large size of the structure.

The phasing and balancing member according to the invention also reduces the need for RF shields compared to prior art, and thus it reduces the manufacturing costs. For instance when a conventional strip line transformer is used, the strip line transformer must be shielded by an RF shielding cover soldered on a separate printed circuit board, if it is desired to achieve the same interference radiation level which is obtained using the phasing and balancing member according to the invention without any particular shields.

The phasing and balancing member according to the invention functions also as a band-pass filter, because it contains at least one resonance circuit. Further the phasing and balancing member according to the invention also operates as an impedance matching means.

The phasing and balancing member according to the invention is particularly well suited to be used in a direct conversion receiver and transmitter, because in direct conversion techniques in a receiver and a transmitter of this type, very important factors are a very good balance of the used I/Q demodulator and I/Q modulator and a coupling from one circuit member to another member, which is as low as possible.

To a person skilled in the art it is obvious that the different embodiments of the invention are not limited to the presented examples, but they may vary in accordance with the enclosed claims.

I claim:

1. A phasing and balancing member, realized with strip lines, constructed to couple a signal between a symmetric interface and an asymmetric interface, said asymmetric interface having a node at a first potential and a zero node, said coupling being accomplished substantially by electromagnetic coupling between said strip lines, said member comprising:

four substantially parallel strip lines having an input strip line pair and an output strip line pair, wherein first ends of said input strip line pair are directly interconnected, and one of said second ends of said input strip line pair being connected to said node at a first potential and the other of said second ends being connected to said zero node of said asymmetric interface, and further wherein each line of said output strip line pair is electromagnetically coupled to one line of said input strip line pair, first ends of said output strip line pair are connected to a point of zero potential of said signal, and second ends of said output strip line pair are connected to said symmetric interface; and a resonance element connected to said second ends of at least one of said strip line pairs to form a resonance circuit, which has a certain predetermined resonance frequency.

2. A phasing and balancing member, as described in claim 1 wherein said strip lines are positioned and coupled so that the signal travels in opposing directions in each of the lines of a pair such that the radiation fields generated by the signal in the lines are substantially canceled.

3. A phasing and balancing member according to claim 1, characterized in that said resonance element comprises a first capacitive member connected to said input strip line pair, whereby said first capacitive member and said input strip line pair form a resonance circuit.

4. A phasing and balancing member according to claim 3, characterized in that said resonance element further comprises a second capacitive member connected to said output strip line pair, whereby said second capacitive member and said output strip line pair form a resonance circuit.

5. A phasing and balancing member realized with strip lines and comprising a symmetric interface (SYM) and an asymmetric interface (ASYM), whereby the electromagnetic coupling between the interfaces is formed substantially with the aid of the electromagnetic coupling between the strip lines of said member, characterized in that it comprises four substantially parallel strip lines whereby said four strip lines form a first strip line pair and a second strip line pair, and whereby the first ends of said first strip line pair are interconnected;

that at least one of said strip line pairs forms a part of a resonance circuit, which has a certain predetermined resonance frequency; and wherein said member, further comprises two strip lines which are located in parallel with the group formed by said four strip lines, one on each side of said group, and both said two strip lines are connected to the ground potential at least at one point.

6. A mobile communication means having A phasing and balancing member, realized with strip lines, constructed to couple a signal between a symmetric interface and an asymmetric interface, said asymmetric interface having a node at a first potential and a zero node, said coupling being accomplished substantially by electromagnetic coupling between said strip lines, said member comprising:

four substantially parallel strip lines having an input strip line pair and an output strip line pair, wherein first ends of said input strip line pair are directly interconnected, and one of said second ends of said input strip line pair being connected to said node at a first potential and the other of said second ends being connected to said zero node of said asymmetric interface, and further wherein each line of said output strip line pair is electromagnetically coupled to one line of said input strip line pair, first ends of said output strip line pair are connected to a point of zero potential of said signal, and second ends of said output strip line pair are connected to said symmetric interface; and a resonance element connected to said second ends of at least one of said strip line pairs to form a resonance circuit, which has a certain predetermined resonance frequency.

* * * * *